US006544636B1

(12) United States Patent
Fukunaga et al.

(10) Patent No.: US 6,544,636 B1
(45) Date of Patent: Apr. 8, 2003

(54) CERAMIC-REINFORCED METAL-BASED COMPOSITE MATERIAL AND A METHOD FOR PRODUCING THE SAME

(75) Inventors: Hideharu Fukunaga, Hiroshima (JP); Makoto Yoshida, Higashi-Hiroshima (JP)

(73) Assignee: Hiroshima University, Higashi-Hiroshima (JP)

( * ) Notice: Subject to any disclaimer, the term of this patent is extended or adjusted under 35 U.S.C. 154(b) by 0 days.

(21) Appl. No.: 09/366,847

(22) Filed: Aug. 4, 1999

(30) Foreign Application Priority Data

Feb. 2, 1999 (JP) ..... 11-025082

(51) Int. Cl.[7] ..... B32B 15/14

(52) U.S. Cl. ..... 428/293.1; 29/419.1; 29/527.5

(58) Field of Search ..... 428/293.1; 427/217; 29/419.1, 527.5

(56) References Cited

FOREIGN PATENT DOCUMENTS

| | | |
|---|---|---|
| JP | 61-076629 | 4/1986 |
| JP | 61-147961 | 7/1986 |
| JP | 62-67136 | 3/1987 |
| JP | 62-164536 | 7/1987 |
| JP | 01-247539 | 10/1989 |
| JP | 02-194131 | 7/1990 |

*Primary Examiner*—Elizabeth M. Cole
(74) *Attorney, Agent, or Firm*—Knobbe Martens Olson & Bear LLP

(57) ABSTRACT

A ceramic metal-reinforced metal-based composite material produced by impregnating, under pressure, a semi-molten alloy having a solid phase and a liquid phase coexistent with each other into a preliminarily molded body composed of ceramic whiskers or ceramic particles.

8 Claims, 2 Drawing Sheets

CERAMIC-REINFORCED METAL-BASED COMPOSITE MATERIAL AND A METHOD FOR PRODUCING THE SAME

BACKGROUND OF THE INVENTION (1) Field of the Invention

The present invention relates to a ceramic material-reinforced metal-based composite material to be favorably used for machine parts and the like, and to a method for producing the same. Particularly, an alloy is converted to a metal-based composite material by impregnating a semi-molten alloy having a semi-molten alloy in a solid/liquid coexistent state into a preliminarily molded body composed of ceramic whiskers or ceramic particles (hereinafter referred to as "preform") under pressure, so that various mechanical properties such as the strength and wear resistance of the resulting machine parts are advantageously enhanced.

(2) Related Art Statement

As one of methods for the production of machine parts, a process is known, which arranges a preform in a part of a casting mold cavity (hereinafter cavity) and converts an alloy into a composite material by casing a completely molten alloy composed of a liquid phase alone in the cavity under pressure.

However, it has been recently necessary to reduce the temperature of the alloy melt from the viewpoint of the prolongation of the life of the casting mold including a mold unit and the energy saving.

As a countermeasure to solve the above problem, use of the semi-molten alloy having the solid phase and the liquid phase in a coexistent state may be considered.

As a method for producing a composite material with use of such a semi-molten alloy, a so-called composite casting process is known, in which ceramic whiskers or particles are mixed and stirred into the molten alloy, and the resulting uniform slurry is cast.

However, although this composite casting process is advantageous from the standpoint of reinforcing the entire machine part, but is not suitable for reinforcing a specified part of the machine part.

Further, since the expensive ceramic fibers or particles are also incorporated into such a portion of the machine part as needs no special strength or wear resistance according to the above composite casting process, this process has the demerit that the production cost of the machine part increases.

SUMMARY OF THE INVENTION

The present invention is to advantageously solve the abovementioned problem, and to propose a process for advantageously producing a ceramic material-reinforced metal-based composite material which cannot only reduce a casting temperature owing to the use of a semi-molten alloy as an alloy component but also impart a desired characteristic such as strength or wear resistance upon a specified portion of a machine part by arranging a preform at only a specified portion in a cavity and impregnating a semi-molten alloy into the preform under pressure.

Since it has been presumed that the preform would be largely deformed if the semi-molten alloy is impregnated into the preform under pressure, neither research nor development of such a process has been reported heretofore.

Therefore, no example has been reported, in which a machine part was partially reinforced with use of a preform in casting a semi-molten alloy under pressure.

According to the inventors' researches, it was discovered that even if the semi-molten alloy is used as a starting material, the deformation of the preform can be almost prevented by the optimization of the strength of the preform, the percentage of the in impregnating the semi-molten alloy into the preform under pressure, so that a desired composite material can be produced.

The present invention is based on the above discovery.

That is, the constituent features of the present invention are as follows.

1. A ceramic metal-reinforced metal-based composite material produced by impregnating, under pressure, a semi-molten alloy having a solid phase and a liquid phase coexistent with each other into a preform composed of ceramic whiskers or ceramic particles.
2. A method for producing a ceramic metal-reinforced metal-based composite material, comprising a step of impregnating, under pressure, a semi-molten alloy having a solid phase and a liquid phase coexistent with each other into a preform composed of ceramic whiskers or ceramic particles.

The following 1 to 3 are preferable embodiments of the ceramic metal-reinforced metal-based composite material-producing method. Any combination thereof is also considered as preferable.

1. The preliminarily molded body is arranged in a part or the entire part of a cavity of a mold, and the semi-molten alloy is cast in the cavity under pressure.
2. The percentage of the solid phase in the semi-molten alloy is 10 wt % to 70 wt %.
3. The pressure-impregnating speed of the semi-molten alloy is 1 to 30 cm/s.

BRIEF DESCRIPTION OF THE DRAWINGS

For a better understanding of the invention, reference is made to the attached drawings, wherein.

DETAILED DESCRIPTION OF THE INVENTION

Figure 1:
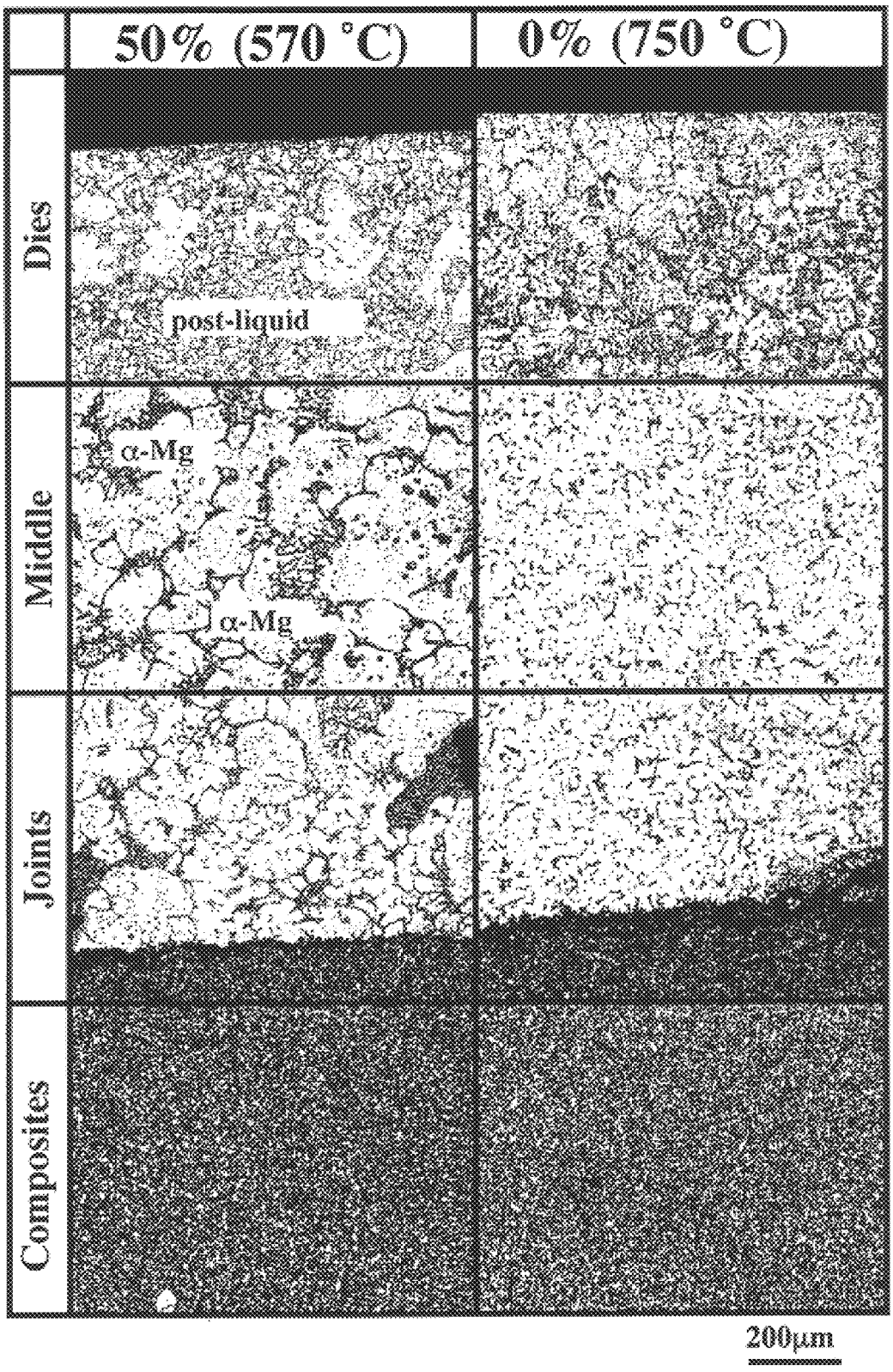
FIG. 1 are metallic tissue microscopic photographs showing metallic tissues of a composite material at a composite portion, a joint portion and alloy portions (a middle portion and a die-side portion) as compared with those a composite material obtained by using a completely melted alloy.

According to the present invention, a composite material for a machine part which is entirely or partially reinforced can be produced by arranging a preform in an entire part or a part of a cavity of the mold and impregnating a semi-molten alloy into the preform in casting under pressure.

The composite material according to the present invention has a tissue formed through a solid phase in the semi-molten alloy being heaped around an interface between the preform and the alloy owing to the filtering action of the preform. The heaped solid phase has a concentration of a solute lower than the initial one of the solute in the semi-molten alloy, so that the heaped solid phase has adequate ductility and therefore can function as a stress-mitigating layer for thermal stress between the composite portion and the alloy portion. The solute may be aluminum, zinc in a magnesium solvent.

In the present invention, as a material for the preform, any conventional material such as an oxide, a nitride, a boride or any combination thereof may be used, and no limitation is posed upon their kinds. Aluminum borate whiskers may be used, for example.

The method of producing the preform is not limited to any particular one. However, producing conditions such as a kind of a binder, a firing temperature and a fiber-occupying volume percentage need to be so optimized that the preform may not be deformed when the semi-molten alloy is impregnated into it.

For example, when $Al_{18}B_4O_{33}$ whiskers are used as a material of the preform, it is preferable that silica gel is as the binder, the firing temperature is around 1000 to around 1200° C., and the fiber-occupying volume percentage is around 10 to around 30%.

With respect to the semi-molten alloy, its alloy is not particularly limited.

Further, the method for producing the semi-molten alloy is not particularly limited, but it is important that the percentage of the solid phase is so set as to prevent the deformation of the preform in impregnating the preform with the semi-molten alloy under pressure.

The percentage of the solid phase in the molten alloy is preferably 10 wt % to 70 wt %.

Further, the pressure-impregnating speed of the semi-molten alloy is preferably around 1 to around 30 cm/s.

EXAMPLES

After a slurry was prepared by stirring and dispersing $Al_{18}B_4O_{33}$ whiskers into distilled water, silica gel was added into the slurry as a binder in an amount of 5 wt % of the total amount of the whiskers. Then, the resulting slurry was dewatered under suction, molded in a given shape, dried, and fired at a temperature of 1160° C., thereby producing a preform having a whisker-occupying volume percentage of about 18 vol %. At that time, the compression strength of the preform was about 5 MPa.

Such a preform is arranged in a cavity of a high pressure casting apparatus, and a semi-molten alloy of Al—9 wt % Al—1 wt % Zn is cast in the cavity under pressure, thereby molding a cast product having a shape of the cavity.

At that time, the liquid phase of the molten alloy is impregnated preferentially into the preform in the cavity, so that the cast composite material partially reinforced with the whiskers can be produced.

As an example, the above pressure-cating process was carried out by a squeezing cast method (pressure-impregnating speed: 20 cm/s) by using a semi-molten AZ91D alloy (Mg—9 wt % Al—1 wt % Zn) having the percentage of a solid phase of 50 wt %, so that a composite material having the preform impregnated with the liquid phase in the semi-molten alloy could be produced with a deformed rate of the preform being not more than 10 vol. %.

FIG. 1 give metallic tissue microscopic photographs of metallic tissues of the thus obtained composite material at a composite portion, a joint portion and alloy portions (a middle portion and a die-side portion).

FIG. 1 also give metallic tissue microscopic photographs of a composite material obtained by using a completely melted alloy according to a similar pressure-casting process.

The tensile strength of the composite material obtained according to the present invention at the interface between the composite portion and the solidified alloy portion was about 120 MPa when not thermally treated.

The tensile strength at the interface of the composite material obtained by using the completely molten alloy in the same manner was almost equal.

Therefore, it was confirmed that even if the semi-molten alloy is used, the tensile strength at the interface comparable to that in the case where the completely molten alloy is used can be obtained.

Figure 2:
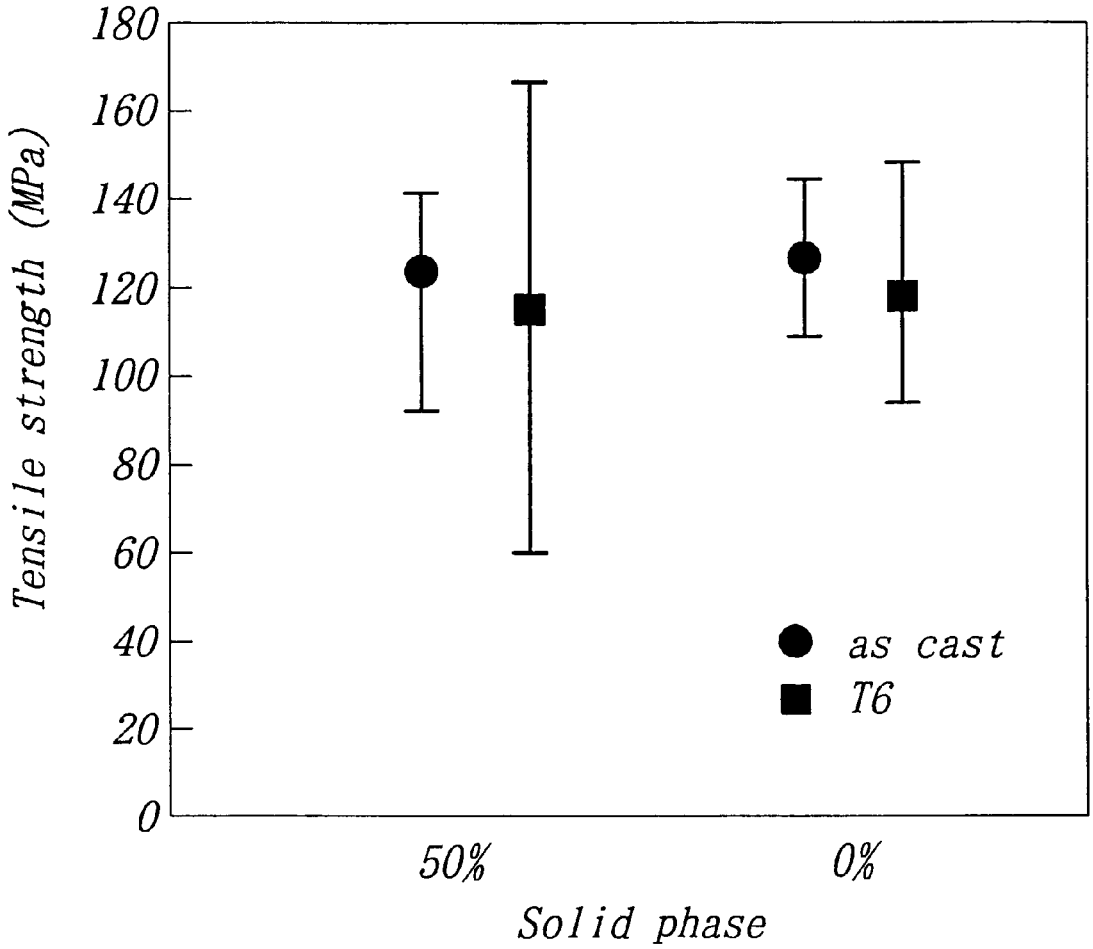
FIG. 2 shows tensile strengths of composite materials obtained according to the present invention at composite portions and alloy portions thereof.

FIG. 2 shows tensile strengths of composite materials obtained according to the present invention at composite portions and alloy portions thereof in comparison.

The analysis of the alloy composition in an inner part of the composite portion of the thus obtained composite material revealed that the alloy composition almost conformed with that of the equilibrium liquid phase of the 50% AZ91D having the percentage of the solid phase being 50 vol %. Thereby, when the semi-molten alloy is used without being limited to the AZ91D alloy, the strength of the solute in the alloy is larger as compared with a case where the preform is impregnated with the completely molten alloy. Accordingly, it is expected that the solid solution of the matrix in the composite material is reinforced, and that the composite material is reinforced with the precipitation of an intermetallic compound.

In actual, the hardness of the composite material obtained by using the completely molten alloy is Hv:150, whereas the hardness of the composite material obtained by using the semi-molten alloy having the percentage of the solid phase being 50 wt % is Hv:180 as increased by about 20%.

The effects of the present invention will be concretely recited as follows.

(1) Since the semi-molten alloy is used for converting the alloy to the composite material according to the present invention, casting defects such as shrinkage cavities can be reduced as compared with a case where the completely molten alloy is used.

(2) Since the semi-molten alloy is used for converting the alloy to the composite material according to the present invention, the temperature in the process is lower as compared with the case where the completely molten alloy is used. Consequently, the service life of the casting mold such as a die unit can be prolonged.

(3) While the merits in the process with the semi-molten alloy is being utilized, desired characteristics such as strength and wear resistance can be afforded upon a necessary portion of the mechanical component.

What is claimed is:

1. A ceramic reinforced metal-based composite material, produced by steps consisting of preparing a preliminarily molded body composed of ceramic whiskers or ceramic particles, and impregnating, under pressure, a semi-molten alloy having a solid phase and a liquid phase coexistent with each other into said preliminarily molded body, said impregnating under pressure being effected at a percentage of the solid phase in the semi-molten alloy in a range of 10 wt % to 70 wt % and a pressure-impregnating speed in a range of 1 to 30 cm/s without causing any substantial deformation of the preliminarily molded body.

2. A method for producing ceramic reinforced metal-based composite material, consisting of the steps of preparing a preliminarily molded body composed of ceramic whiskers or ceramic particles, and impregnating, under pressure, a semi-molten alloy having a solid phase and a liquid phase coexistent with each other into said preliminarily molded body, said impregnating under pressure being effected at a percentage of the solid phase in the semi-molten alloy in a range of 10 wt % to 70 wt % and a pressure-impregnating speed in a range of 1 to 30 cm/s without causing any substantial deformation of the preliminarily molded body.

3. The ceramic-reinforced metal-based composite material-producing method set forth in claim 2, wherein the preliminarily molded body is arranged in a part or the entire part of a cavity of a mold, and the semi-molten alloy is cast in the cavity under pressure.

4. A ceramic-reinforced metal-based composite material comprising a preformed ceramic body impregnated with an alloy, obtained by impregnating the preformed ceramic body with a semi-molten alloy under pressure without substantial deformation of the preformed ceramic body, said preformed ceramic body being composed of ceramic whiskers or ceramic particles, said ceramic-reinforced metal-based composite material comprising (i) a ceramic-metal matrix body formed in the preformed ceramic body mainly by a liquid phase of said alloy, (ii) an alloy portion formed outside the preformed ceramic body mainly by a solid phase of said alloy, and (iii) an intermediate portion formed therebetween by a liquid phase and a solid phase of said alloy, wherein the alloy portion, the intermediate portion, and the ceramic-metal matrix body are formed continuously.

5. The ceramic-reinforced metal-based composite material according to claim 4, wherein said semi-molten alloy comprises the solid phase in the range of 10–70% by weight.

6. The ceramic-reinforced metal-based composite material according to claim 4, wherein said preformed ceramic body is composed of an oxide, nitride, or boride.

7. The ceramic-reinforced metal-based composite material according to claim 6, wherein said preformed ceramic body is composed of aluminum borate whiskers.

8. The ceramic-reinforced metal-based composite material according to claim 4, wherein said preformed ceramic body has a fiber-occupying volume of 10–30%.

* * * * *